US005941082A

United States Patent [19]

Huang

[11] Patent Number: 5,941,082

[45] Date of Patent: Aug. 24, 1999

[54] METHOD OF CLEANING THE COOLING LOOP AN AIR CONDITIONING SYSTEM AND CLEANING SYSTEM THEREFORE

[76] Inventor: Ta-Hsin Huang, No. 24, Alley 1, Lane 727, Chia Chang Rd., Nan Tzu, Koahsiung, Taiwan

[21] Appl. No.: 09/007,061

[22] Filed: Jan. 14, 1998

[51] Int. Cl.[6] ..... F25B 45/00; F25B 43/04; B08B 9/20; F28G 13/00

[52] U.S. Cl. ..... 62/77; 62/475; 62/292; 165/95; 15/3.51

[58] Field of Search ..... 62/77, 292, 303, 62/475; 165/95; 15/3.5, 3.51

[56] References Cited

U.S. PATENT DOCUMENTS 4,237,962 12/1980 Vandenhoeck ..... 165/95
5,168,720 12/1992 Keltner ..... 62/303

*Primary Examiner*—William Doerrler
*Attorney, Agent, or Firm*—Varndell Legal Group

[57] ABSTRACT

A cleaning system which includes a piping system connected between two opposite ends of the cooling loop of an air conditioning system and two opposite ends of a cooling medium reclaiming machine, a first storage tank and a second storage tank respectively connected between the two opposite ends of the cooling loop of the air conditioning system and the piping system, and a plurality of valves provided at the piping system for controlling the flowing direction of a cooling medium between the cooling loop of the air conditioning and the cooling medium reclaiming machine, and a hard grained material carried with the cooling medium through the cooling loop of the air conditioning system between the storage tanks to rub dirty deposit away from the inside wall of the cooling loop of the air conditioning system.

2 Claims, 4 Drawing Sheets

METHOD OF CLEANING THE COOLING LOOP AN AIR CONDITIONING SYSTEM AND CLEANING SYSTEM THEREFORE

BACKGROUND OF THE INVENTION

The present invention relates to a method of cleaning the cooling loop of an air conditioning system, which uses hard grained material to rub dirty deposit away from the inside wall of the cooling loop when pumping a cooling medium through the cooling loop of the air conditioning system.

FIG. 1 shows a cleaning system for cleaning the cooling loop of an air conditioning system. The cleaning system comprises a cooling medium reclaiming machine, an oil accumulator, a filter, and a cooling medium accumulator, and a plurality of control valves. When cleaning the cooling loop of the air conditioning system, the valves of the cleaning system are operated, permitting the piping of the cleaning system to be processed into a vacuum status, then the valves are operated again, permitting a cooling medium to be sucked from the cooling loop of the air conditioning system through the filter to the cooling medium reclaiming machine. The procedure is repeated several times. Then, the valves are operated again, permitting an oil to be sucked from the oil accumulator through the cooling loop of the air conditioning system to the cooling medium reclaiming system, and then the cooling medium reclaiming system is operated to separate the oil from the cooling medium. This conventional cooling loop cleaning method cannot effectively remove dirty deposit from the inside wall of the cooling loop, therefore its cleaning effect is doubtful.

SUMMARY OF THE INVENTION

The present invention has been accomplished to eliminate the aforesaid problem. According to the present invention, hard grained material is carried with the cooling medium through the air conditioning system to rub dirty deposit away from the inside wall of the cooling loop, when the cooling medium is pumped through the cooling loop of the air conditioning system.

DETAILED DESCRIPTION OF THE PREFERRED EMBODIMENT

Figure 1:
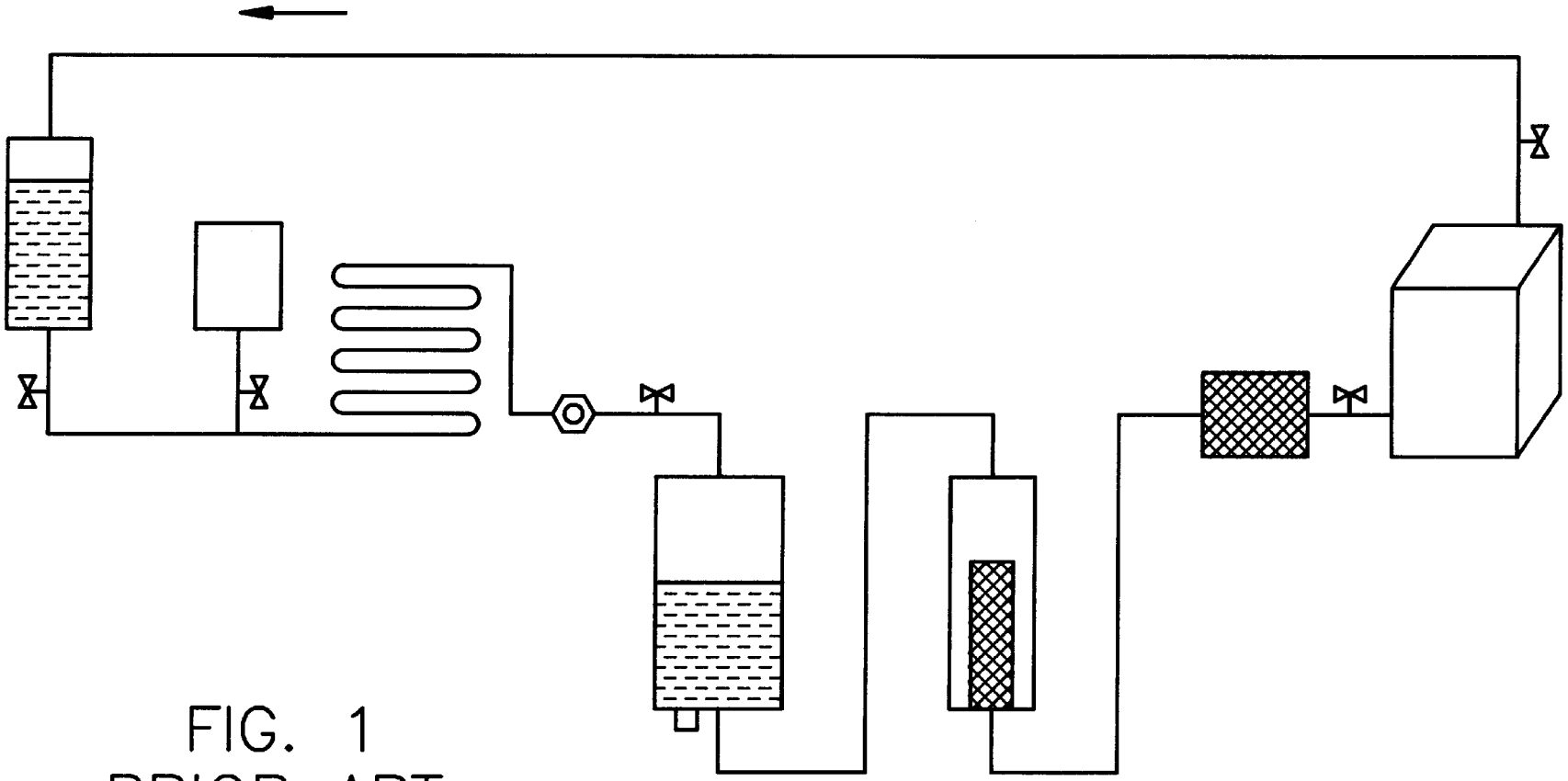
FIG. 1 PRIOR ART
FIG. 1 shows a cooling loop cleaning arrangement according to the prior art.
Figure 2:
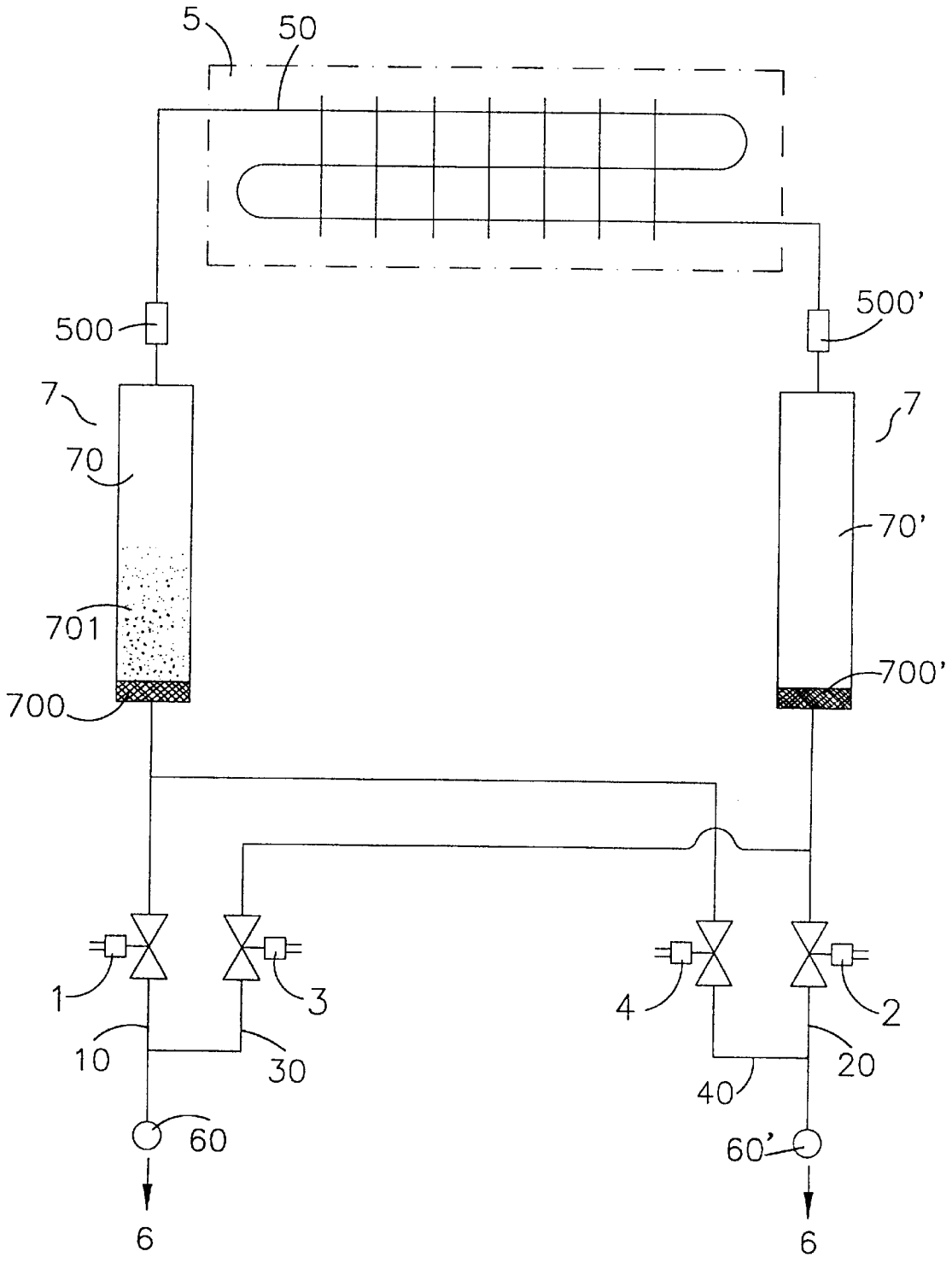
FIG. 2 shows a cleaning system connected between the cooling loop of an air conditioning system and a cooling medium reclaiming machine according to the present invention.

Referring to FIG. 2, a cleaning system 7 is connected between the connectors 500;500' at two opposite ends of the cooling loop 50 of an air conditioning system 5 and the connectors 60;60' at two opposite ends of a cooling medium reclaiming machine 6. The cleaning system 7 comprises a piping system which is comprised of a plurality of pipes 10;20;30;40 connected to one another, two storage tanks

70;70' connected between pipes 10;20 and the connectors 500;500' of the cooling loop 50 of the air conditioning system 5, and valves 1;2;3;4 respectively provided at pipes 10;20;30;40. The storage tanks 70;70' have a respective bottom open side covered with a wire gauze filter 700;700'. Grains of hard material 71 are filled in the storage tanks 70;70'. The open spaces on the wire gauze filters 700;700' are smaller than the sizes of the grains 71.

Figure 3:
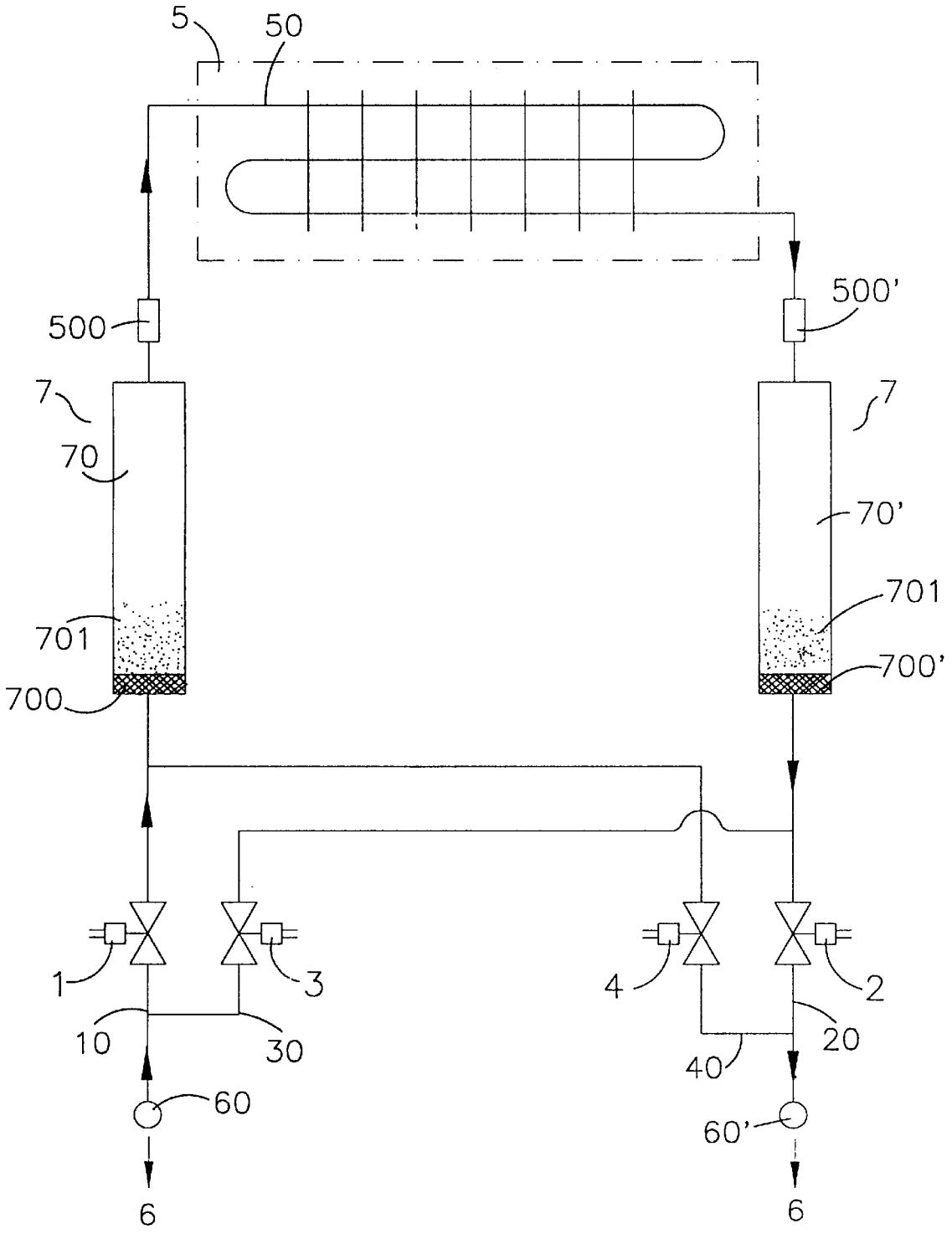
FIG. 3 shows the cleaning system operated, the cooling medium passed from the first storage tank through the cooling loop of the air conditioning system to the second storage tank according to the present invention.

The procedure of cleaning the cooling loop 50 of the air conditioning system 5 is outlined hereinafter with reference to FIG. 3.

1. Open the two outer valves, namely, the first and second valves 1;2;
2. Operating the cooling medium reclaiming machine 6 to pump cooling medium for example freon through the first pipe 10 to the first storage tank 70 then into the air conditioning system 5, permitting grains 701 to be carried into the cooling loop 50 to rub dirty deposit away from the inside wall of the cooling loop 50 and then to be carried with cooling medium to the second storage tank 70';
3. Grains 701 and solid dirty particles are removed from cooling medium by the wire gauze filter 700' when cooling medium passes through the second storage tank 70' to the cooling medium reclaiming machine 6.

Figure 4:
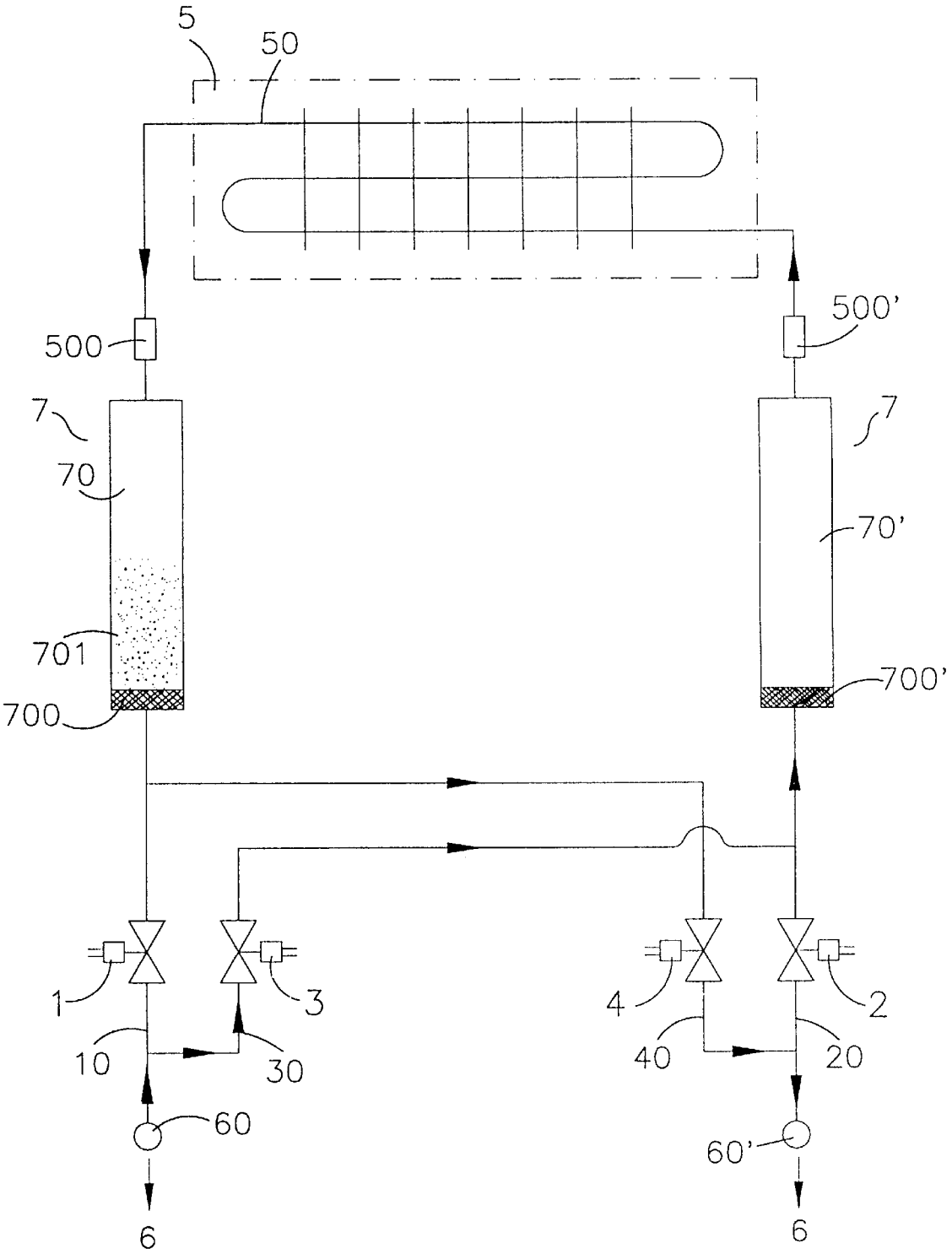
FIG. 4 shows the cleaning system operated, the cooling medium passed from the second storage tank through the cooling loop of the air conditioning system to the first storage tank.

A secondary cleaning procedure is outlined hereinafter with reference to FIG. 4.

1. Close the first and second valves 1;2, and open the two inner valves namely, the third and fourth valves 3;4;
2. Operating the cooling medium reclaiming machine 6 to pump cooling medium through the third pipe 30 to the second pipe 2 then to the second storage tank 70' to carry grains 701 away from the second storage tank 70' into the cooling loop 50 of the air conditioning system 5 for rubbing the inside wall of the cooling loop 50, permitting grains 701 and dirty solid particles to be carried with cooling medium to the first storage tank 70;
3. Grains 701 and solid dirty particles are removed from cooling medium by the wire gauze filter 700 when cooling medium passes through the first storage tank 70 to the cooling medium reclaiming machine 6.

What the invention claimed is:

1. A cleaning system for a method of of cleaning a cooling loop of an air conditioning system, the method comprising pumping a cooling medium from a cooling medium reclaiming machine through the cooling loop of the air conditioning system via the cleaning system, permitting a hard grained material to be carried with the cooling medium through the cooling loop to rub dirty deposits away from the inside of the cooling loop, the cleaning system comprising a piping system including a plurality of pipes connected between two opposite ends of the cooling loop of an air conditioning system and two opposite ends of a cooling medium reclaiming machine, a first storage tank and a second storage tank respectively connected between the two opposite ends of the cooling loop of said air conditioning system and the piping system, and a plurality of valves provided at said piping system for controlling the flowing direction of a cooling medium between the cooling loop of said air conditioning and said cooling medium reclaiming machine, and said hard grained material carried with said cooling medium through the cooling loop of the air conditioning system between said storage tanks, said first and second storage tanks having each a bottom end covered with a respective water filter means which prohibits said hard grained material from passing through.

2. The cleaning system of claim 1, wherein said valves are respective turned between a first position where said cooling medium is allowed to pass from said cooling medium reclaiming machine through said first storage tank to said second storage tank via the cooling loop of said air conditioning system, and a second position where said cooling medium is allowed to pass from said cooling medium reclaiming machine through said second storage tank to said first storage tank via the cooling loop of said air conditioning system.

* * * * *